US005503733A

United States Patent [19]

Speckmann et al.

[11] Patent Number: 5,503,733

[45] Date of Patent: Apr. 2, 1996

[54] PROCESS FOR PHOSPHATING GALVANIZED STEEL SURFACES

[75] Inventors: Horst-Dieter Speckmann, Langenfeld; Reinhard Seidel, Monheim, both of Germany; Gerard Veldman, Swalmen, Netherlands; Karl-Dieter Brands, Duesseldorf, Germany

[73] Assignee: Henkel Kommanditgesellschaft auf Aktien, Duesseldorf, Germany

[21] Appl. No.: 406,943

[22] PCT Filed: Sep. 20, 1993

[86] PCT No.: PCT/EP93/02538

§ 371 Date: Mar. 28, 1995

§ 102(e) Date: Mar. 28, 1995

[87] PCT Pub. No.: WO94/08074

PCT Pub. Date: Apr. 14, 1994

[30] Foreign Application Priority Data

Sep. 28, 1992 [DE] Germany ..... 42 32 292.8

[51] Int. Cl.[6] ..... C25D 11/36

[52] U.S. Cl. ..... 205/318; 205/177; 205/188

[58] Field of Search ..... 205/177, 188, 205/197, 199, 318

[56] References Cited

U.S. PATENT DOCUMENTS

| | | | |
|---|---|---|---|
| 4,639,295 | 1/1987 | Miyamoto et al. | 204/38.1 |
| 4,865,653 | 9/1989 | Kramer | 205/318 X |
| 5,112,414 | 5/1992 | Brands et al. | 148/254 |
| 5,401,381 | 3/1995 | Seidel et al. | 205/177 |

FOREIGN PATENT DOCUMENTS

| | | |
|---|---|---|
| 0171790 | 2/1986 | European Pat. Off. . |
| 0340530 | 11/1989 | European Pat. Off. . |
| 0454211 | 10/1991 | European Pat. Off. . |
| 0459541 | 12/1991 | European Pat. Off. . |
| 2043085 | 8/1970 | Germany . |
| 2038105 | 2/1972 | Germany . |
| 3146265 | 6/1982 | Germany . |
| 4031817 | 4/1992 | Germany . |
| 4111186 | 10/1992 | Germany . |
| 50/161429 | 12/1975 | Japan . |
| 52/047537 | 4/1977 | Japan . |
| 60/211080 | 10/1985 | Japan . |
| 62-260073 | 11/1987 | Japan . |
| 1/219193 | 9/1989 | Japan . |
| 85/03089 | 7/1985 | WIPO . |

OTHER PUBLICATIONS

"Die Phosphatierung von Metallen", Eugen G. Leuze Verlag, 2nd Edition 1988, pp. 20, 56, 79 et seq. and 107.

M. H. Abbas, Finishing, Oct. 1984, pp. 30–31.

*Primary Examiner*—John Niebling

*Assistant Examiner*—William T. Leader

*Attorney, Agent, or Firm*—Ernest G. Szoke; Wayne C. Jaeschke; Norvell E. Wisdom, Jr.

[57] ABSTRACT

The invention relates to a process for phosphating galvanized steel surfaces, preferably electrolytically or hot-dip galvanized surfaces of steel strip, by treating them in a bath or spray with acidic aqueous phosphating solutions, wherein the workpieces are given a d.c. cathodic treatment at the same time. In the process, (a) the phosphating solutions contain $Zn^{+2}$ cations in the range from 0.1 to 5 g/l, $PO_4^{-3}$ anions in the range from 5 to 50 g/l, $NO_3^-$ anions in the range from 0.1 to 50 g/l, $Mn^{+2}$ cations in the range from 0.1 to 5 g/l, and $Cu^{+2}$ cations in the range from 0.001 to 1 g/l; (b) the following conditions are used: pH of the phosphating solution in the range from 1.5 to 4.5, temperature of the phosphating solution in the range from 10° to 80° C., treatment time in the range from 1 to 300 sec; and (c) the workpieces are also cathodically treated with a direct current with a density in the range from 0.01 to 100 mA/cm$^2$ during phosphating.

20 Claims, No Drawings

PROCESS FOR PHOSPHATING GALVANIZED STEEL SURFACES

FIELD OF THE INVENTION

This invention relates to a process for phosphating galvanized steel surfaces, preferably electrolytically galvanized or hot-dip-galvanized steel strip surfaces, by immersion or spray-immersion treatment thereof with acidic aqueous solutions which, in addition to zinc, phosphate and nitrate ions, contain ions of at least two other divalent metals, the workpieces simultaneously being cathodically treated with a direct current.

STATEMENT OF RELATED ART

It has been known to the expert for some considerable time that high proportions of heavy metal ions, more particularly nickel ions, in phosphate coatings can lead to particularly effective corrosion prevention, cf. for example WO-A-85/03089. However, it is also known in this connection that, to obtain high nickel contents in phosphate coatings, high concentrations of nickel must also be present in the phosphating solutions to be used. On the one hand, this increases process costs in view of the high price of nickel. On the other hand, relatively large quantities of toxic nickel compounds also have to be removed from the spent phosphating solutions because, in general, only about 2% of the nickel is incorporated in the phosphate coatings from the phosphating solutions.

Accordingly, efforts are being made for ecological and physiological reasons to eliminate the need for nickel, which is classified as toxicologically particularly hazardous, without incurring disadvantages in regard to corrosion prevention and paint adhesion. EP-A-459 541 proposes using phosphating solutions containing 1 to 30 mg/l Cu(II) in addition to 0.3 to 1.7 g/l zinc and 0.2 to 4.0 g/l manganese for this purpose.

The positive effect of copper on the formation of phosphate coatings has been known for some time in the prior art, cf. for example W. Rausch, *Die Phosphatierung von Metallen* [Title in English: The Phosphating of Metals], 2nd Edition (Eugen G. Leuze Verlag, 1988), pages 20, 56, 79 et seq. and 107. The copper ions may be added either to the phosphating bath itself or to a preceding activating bath, for example based on colloidal titanium polyphosphates. For example, EP-A-454 211 describes an activating bath containing titanium phosphate to which copper is added in quantities of 1 to 100 mg/l. However, a copper content of 1 to 100 mm/l can also be expected to have a favorable effect on titanium-free activating baths of the type described, for example, in EP-A-340 530.

In addition, the application of electric current in phosphating processes is known per se. Thus, a cathodic treatment, for example, results in acceleration of the phosphating process (cf. M. H. Abbas, *Finishing*, October 1984, pages 30–31). Corrosion-inhibiting coatings can be applied by deposition to galvanized steel surfaces by using acidic aqueous solutions based on aluminum phosphate and/or magnesium phosphate or polycondensed phosphoric acid and simultaneously applying cathodic currents (cf. JP-A-77/047 537, JP-A-75/161 429 and JP-A-89/219 193). JP-A-85/211 080 relates to a process for the production of corrosion-inhibiting layers on metal surfaces using zinc phosphating solutions with periodic application of a cathodic current. A corrosion-resistant protective layer is produced in this way, particularly along the edges of the metal surfaces to be treated. A similar process is described in EP-A-171 790. In this process, the metal surfaces are treated after conventional zinc phosphating with an acidic aqueous solution containing zinc, phosphate and chlorine ions, a direct current simultaneously being applied to the metal surfaces acting as anodes.

According to JP-A-87/260 073, phosphating coatings of high abrasion resistance can be produced on iron in acidic phosphating baths containing phosphoric acid, manganese and copper ions to which cathodic currents are applied. However, the phosphating of surface-finished material and the simultaneous use of zinc ions are not mentioned in this document. The phosphating of electrolytically galvanized or hot-dip-galvanized steel surfaces by this process was unsuccessful.

German patent application P 41 11 186.9 also describes a process for phosphating metal surfaces, preferably electrolytically galvanized or hot-dip-galvanized steel strip surfaces, using acidic aqueous phosphating solutions, the workpieces simultaneously being cathodically treated with a direct current. The phosphating solutions used in this process contain zinc, nickel and/or cobalt cations and phosphate and nitrate anions.

DESCRIPTION OF THE INVENTION

OBJECT OF THE INVENTION

By contrast, the problem addressed by the present invention was to provide a process for phosphating galvanized steel surfaces in which equally good protection against corrosion would be obtained—despite the intentional absence of the now undesirable nickel ions—by the use of manganese ions in the zinc-containing phosphating solutions. Another problem addressed by the present invention was significantly to increase the rate of incorporation of manganese in the phosphate coatings formed although only comparatively low concentrations of manganese cations are present in the phosphating solutions used.

SUMMARY OF THE INVENTION

Accordingly, the present invention relates to a process for phosphating galvanized steel surfaces, preferably electrolytically galvanized or hot-dip-galvanized steel strip surfaces, by immersion or spray/immersion treatment thereof with acidic aqueous solutions which, in addition to zinc, phosphate and nitrate ions, also contain ions of at least two other divalent metals, characterized in that:

a) phosphating solutions containing the following components are used:
$Zn^{2+}$ cations in quantities of 0.1 to 5 g/l,
$PO_4^{3-}$ anions in quantities of 5 to 50 g/l,
$NO_3^-$ anions in quantities of 0.1 to 50 g/l and
$Mn^{2+}$ cations in quantities of 0.1 to 5 g/l and
$Cu^{2+}$ cations in quantities of 0.001 to 1 g/l, b) the following conditions are established: pH value of the phosphating solutions 1.5 to 4.5, temperature of the phosphating solutions 10° to 80° C., treatment time 1 to 300 seconds, c) the workpieces are cathodically treated during phosphating with a direct current having a density of 0.01 to 100 mA/cm$^2$.

It has surprisingly been found that the rate of incorporation of manganese in the phosphate coatings can be considerably increased by application of a cathodic direct current to the workpiece during phosphating and by the simultaneous presence of copper cations in the zinc-containing phosphating solutions, so that—despite comparatively low concentrations of manganese cations in the phosphating solution—the phosphate coatings can be provided with high levels of manganese similar to those which, hitherto, could only be achieved when the phosphating solutions had comparatively high concentrations of manganese cations. Another advantage of the present invention is that the phosphate coatings obtained by the process according to the invention afford a level of protection against corrosion comparable with that which otherwise could only be achieved with nickel-containing phosphating solutions.

According to the invention, it is crucially important to maintain all the parameters mentioned above when carrying out the phosphating process. In other words, the treatment of the workpieces with cathodic direct current during phosphating only produces the required result in corresponding zinc-containing phosphating solutions which contain manganese and copper cations together, as defined in detail in the foregoing.

Where galvanized metal surfaces are mentioned in connection with the present invention, they are understood to be material surfaces of electrolytically galvanized or hot-dip-galvanized or even alloy-galvanized steel, preferably electrolytically galvanized or hot-dip-galvanized steel strip. By steel is meant unalloyed to low-alloyed steel of the type used, for example, in the form of sheets for automotive bodywork. The use of galvanized steel, particularly electrolytically galvanized steel in strip form, has grown considerably in significance in recent years. The expression "galvanized steel" in the context of the present invention is understood to encompass electrolytically galvanized steel and also hot-dip-galvanized steel and also applies generally to alloy-galvanized steel, zinc/nickel alloys, zinc/iron alloys (Galvanealed) an zinc/aluminum alloys (Galfan, Galvalume) playing a particularly crucial role as zinc alloys.

The process according to the invention is preferably carried out on the immersion principle. In general, however, the phosphating solutions according to the invention may also be applied to the substrate surfaces by spray/immersion treatment. The workpieces to be treated are connected as cathodes for the phosphating treatment, an electrode of stainless steel for example being used as the counterelectrode. In general, a metal container for the phosphating bath may also be used as the counterelectrode. Graphite electrodes, noble metal electrodes, for example of platinum or gold, electrodes which merely have a coating of the noble metals mentioned or in which the noble metals are implanted or, basically, any electrode materials known from the relevant prior art may also be used as the counterelectrode.

In the context of the invention, the expression "direct current" is understood to include not only "pure" direct currents but also currents of virtually the same type, for example currents which can be produced by full-wave rectification of a single-phase alternating current or by rectification of a three-phase alternating current. So-called pulsating direct currents and chopped direct currents may also be used for the purposes of the invention. It is merely the current density of the direct current, which should lie in the range defined above, that is important in the context of the invention. Suitable voltage values for the direct current to be used in accordance with the present invention have deliberately not been mentioned because a different relationship between current and voltage can exist taking into consideration the various conductivities of the phosphating baths on the one hand and the geometric arrangement of the electrodes on the other hand. In addition, concentration gradients which are determined by the current density and not by the bath voltage are crucial to the mechanism by which the phosphate coatings are formed. In each individual case, the expert will select suitable voltage values on the basis of the current density values mentioned for carrying out the process according to the invention.

DESCRIPTION OF PREFERRED EMBODIMENTS

One preferred embodiment of the present invention is characterized by the use of phosphating solutions containing the following components:

$Zn^{2+}$ cations in quantities of 0.5 to 2 g/l, $PO_4^{3-}$ anions in quantities of 10 to 20 g/l, $NO_3^-$ anions in quantities of 1 to 30 g/l and $Mn^{2+}$ cations in quantities of 0.5 to 2 g/l and $Cu^{2+}$ cations in quantities of 0.01 to 0.5 g/l.

In another preferred embodiment of the process according to the invention, the following conditions are maintained in the phosphating treatment of the workpieces: pH value of the phosphating solutions 2 to 3, temperature of the phosphating solutions 40° to 70° C., treatment time 2 to 30 seconds.

In another preferred embodiment of the invention, the workpieces are cathodically treated during phosphating with a direct current having a density of 1 to 50 mA/cm$^2$.

In another embodiment of the process according to the invention, the phosphating baths may additionally contain magnesium cations. Although the incorporation of these cations in the phosphate coating is not significantly promoted by the application of direct current in accordance with the invention, it is not impeded either.

In this embodiment of the process according to the invention, it is preferred to use phosphating solutions additionally containing $Mg^{2+}$ cations in quantities of 0.01 to 2 g/l and preferably in quantities of 0.1 to 1 g/l. The additional use of magnesium cations in the phosphating baths according to the invention improves the corrosion resistance of the phosphate coatings obtained.

In the phosphating of hot-dip-galvanized or alloy-galvanized steel surfaces by the process according to the invention, the use of fluoride ions leads to a more uniform coverage of the phosphate coatings on such surfaces. Accordingly, it is preferred in accordance with the invention to use phosphating solutions additionally containing simple or complex fluoride anions in quantities of 0.1 to 50 g/l and preferably in quantities of 0.2 to 2 g/l. In the phosphating of electrolytically galvanized steel surfaces, the presence of fluoride anions is not necessary although their presence does not affect the phosphating process according to the invention in these cases either. According to the invention, the fluoride anions may also be used in the form of complex fluorine compounds, for example tetrafluoroborate or hexafluorosilicate.

As already mentioned, it is crucially important to maintain all the parameters mentioned if the process according to the invention is to be optimally carried out. These parameters include inter alia the above-mentioned pH range. If the pH value of the phosphating bath is not in the range mentioned, the phosphating bath has to be adjusted to pH values in the range mentioned by addition of acid, for example phosphoric acid, or even by the addition of an alkali, for example sodium hydroxide. Where free acid and total acid contents of the phosphating solutions are mentioned in the following Examples, the corresponding values were determined by the method described in the literature. Accordingly, the so-called point count of free acid is defined as the quantity of 0.1N NaOH in ml which is needed to titrate 10 ml of bath solution against dimethyl yellow, methyl orange or bromphenol blue. The total acid point count is thus the quantity of 0.1N NaOH in ml which is needed to titrate 10 ml of bath solution using phenolphthalein as indicator until the first pink coloration appears. The phosphating solutions according to the invention generally have free acid point counts of 0.5 to 3 and total acid point counts of 15 to 25.

The phosphating baths for carrying out the process according to the invention are generally prepared by any of the methods known per se to the expert. The following compounds, for example, are suitable starting products for the preparation of the phosphating bath: zinc in the form of zinc oxide or zinc nitrate; manganese in the form of manganese carbonate; copper in the form of copper nitrate; magnesium in the form of magnesium nitrate, magnesium oxide, magnesium hydroxide or magnesium hydroxycarbonate; phosphate, preferably in the form of phosphoric acid; nitrate in the form of the salts mentioned above -optionally even in the form of the sodium salt. The fluoride ions optionally used in the bath are preferably used in the form of sodium fluoride or in the form of the complex compounds mentioned above. The compounds mentioned above are dissolved in water in the concentration ranges crucial to the invention. The pH of the phosphating solutions is then adjusted to the required value, again as mentioned above.

Before the actual phosphating treatment, the metal surface to be treated must be completely wettable with water. To this end, the metal surfaces to be treated generally have to be cleaned and degreased by methods known per se and adequately described in the prior art. In addition, it is preferred in accordance with the invention to subject the cleaned and degreased workpieces to be phosphated to an activating pretreatment known per se after they have been rinsed with water, preferably deionized water. The titanium-containing activating solutions described, for example, in DE-A-20 38 105 and in DE-A-20 43 085 are particularly suitable for this purpose. Accordingly, the metal surfaces to be subsequently phosphated are treated with solutions essentially containing titanium salts and sodium phosphate, optionally together with organic components, for example alkyl phosphonates or polycarboxylic acids, as activating agents. Preferred titanium components are soluble compounds of titanium, such as potassium titanium fluoride and, in particular, titanyl sulfate. Disodium orthophosphate is generally used as the sodium phosphate. Titanium-containing compounds and sodium phosphate are used in such quantities that the titanium content is at least 0.005% by weight, based on the weight of the titanium-containing compound and the sodium phosphate.

This activating treatment is followed by the actual phosphating process. The phosphated metal surfaces are then re-rinsed with water, preferably deionized water. In certain cases, it can be of advantage to passivate the phosphate coatings thus produced in a following process step. Passivation is always useful and of advantage when the metal surfaces phosphated by the process according to the invention are subsequently painted or otherwise coated with organic materials. As sufficiently known to the expert, this passivating treatment may be carried out, for example, with dilute chromic acid or with mixtures of chromic and phosphoric acid. The chromic acid concentration is generally between 0.01 and 1 g/l. An alternative is the passivating treatment with chromium-free products which is described, for example, in DE-A-31 46 265 or DE-A-40 31 817. However, if thereafter the phosphated substrates are first mechanically formed and subsequently rephosphated, as is the case for example in bodywork construction, no passivating treatment should be applied.

The phosphate coatings produced by the process according to the invention may be effectively used in any applications where phosphate coatings are used. A particularly advantageous application is the preparation of the metal surfaces for painting, for example by spraying or electrodeposition, or for coating with organic films.

The process according to the invention is illustrated by the following Examples.

EXAMPLES

The compositions of the phosphating baths used, including the respective pH values and the free acid and total acid contents, are shown in Table 1 below for Examples 1 to 3 according to the invention and for Comparison Examples 1 to 3.

In Examples 1 to 3 according to the invention, a cathodic direct current with various current densities was applied to the test plates throughout the immersion treatment thereof in the respective phosphating baths; the respective current densities are shown in Table 2. In every case, a platinum electrode was used as the counterelectrode.

By contrast, phosphating was carried out without the direct current treatment in Comparison Examples 1 to 3. The phosphating baths used for Comparison Examples 1 to 3 otherwise correspond to those used for Examples 1 to 3 according to the invention.

For all the Examples and Comparison Examples, electrolytically galvanized steel

TABLE 1

| | Composition of the phosphating baths | | | | | | | |
|---|---|---|---|---|---|---|---|---|
| Example No. | $Zn^{2+}$ | $Cu^{2+}$ | $Mn^{2+}$ in [g/l] | $NO_3^-$ | $PO^{3-}$ | pH | FA points | TA points |
| 1 | 1.6 | 0.01 | 1.0 | 2.3 | 12.3 | 2.7 | 1.5 | 20 |
| 2 | 1.6 | 0.1 | 1.0 | 2.5 | 12.3 | 2.7 | 1.5 | 21 |
| 3 | 1.6 | 0.2 | 1.0 | 2.7 | 12.3 | 2.7 | 1.5 | 23 |
| Comp. 1 | 1.6 | 0.01 | 1.0 | 2.3 | 12.3 | 2.7 | 1.5 | 20 |
| Comp. 2 | 1.6 | 0.1 | 1.0 | 2.5 | 12.3 | 2.7 | 1.5 | 21 |
| Comp. 3 | 1.6 | 0.2 | 1.0 | 2.7 | 12.3 | 2.7 | 1.5 | 23 |

Comp. = Comparison Example
FA = Free Acid
TA = Total Acid

TABLE 2

Current density: phosphating time, Cu content and Mn content of the phosphate coatings, coating weights and corrosion test results

| Ex. No. | Current density [mA/cm$^2$] | Time [s] | Cu % by weight | Mn % by weight | Coating weight [g/m$^2$] | Paint creepage [mm] |
|---|---|---|---|---|---|---|
| 1 | 5 | 5 | Traces | 4.9 | 1.4 | 13 |
| 2 | 5 | 5 | 0.5 | 5.1 | 1.5 | 9 |
| 3 | 2 | 5 | 0.7 | 5.1 | 1.8 | 9 |
| 3 | 5 | 5 | 0.7 | 6.1 | 1.8 | 7.5 |
| 3 | 5 | 30 | 0.6 | 7.1 | 2.7 | 6.0 |
| 3 | 10 | 5 | 0.8 | 7.8 | 2.0 | 7.0 |
| Comp. 1 | 0 | 5 | Traces | 3.8 | 0.7 | >20 |
| Comp. 2 | 0 | 5 | 0.5 | 4.2 | 1.2 | >20 |
| Comp. 3 | 0 | 5 | 0.7 | 4.8 | 1.8 | 17 |
| Comp. 3 | 0 | 30 | 0.9 | 4.6 | 2.0 | 10 |

plates (measuring 10 cm×20 cm×0.7 cm; 7.5 μm thick zinc coating on both sides) from Thyssen AG, Duisburg, were used as the test plates. Except for the direct current treatment mentioned above, the test plates used for the respective Examples and Comparison Examples were treated in the same way by the following process steps:

1) Chemical cleaning and degreasing using a surfactant- and phosphate-containing alkaline cleaner (Ridoline® C 1250 E, a product of Henkel KGaA) in a concentration of 2% by weight in aqueous solution, spray application for 3 minutes at around 60° C.
2) Rinsing with deionized water for 30 seconds at room temperature.
3) Activation using a water-based activating preparation containing titanium salt (Fixodine® 6, a product of Henkel KGaA) in a concentration of 0.2% by weight, dip application for 5 seconds at room temperature.
4) Phosphating by immersion in the respective phosphating baths according to Table 1 at 60° C.; the respective phosphating times are shown in Table 2.
5) Rinsing with deionized water for 30 seconds at room temperature.
6) Drying for 10 minutes at an object temperature of 80° C.

After drying, the respective test plates were coated with an epoxy-based cathodic electrodeposition paint (Aqualux® K, a product of ICI, Hilden). The dry film thickness was 18±2 μm.

The corrosion protection of the respective phosphate coatings was then determined by determining paint creepage in a cathodic polarization test. To this end, the respective test plates were provided with a single cut in accordance with DIN 53 167 and then immersed in a 10% by weight aqueous $Na_2SO_4$ solution for a polarization time of 40 hours with a current flow of 0.75 A. Lacquer creepage was evaluated in accordance with DIN 53 167 (see Table 2).

The weights of the phosphate coatings were determined by differential weighing (weight of the phosphate-coated test plate)-(weight of the test plate after removal of the phosphate coating with chromic acid). In addition, the phosphate coatings on the respective test plates were removed with chromic acid and analyzed by AAS spectroscopy in order to determine their composition.

The results obtained in the above-mentioned tests are set out in Table 2 above.

Comparison of the results set out in Table 1 in regard to the composition of the respective phosphating baths with those set out in Table 2 in regard to the manganese content of the phosphate coatings shows that, by virtue of the process according to the invention with relatively low manganese concentrations in the phosphating baths, comparatively high levels of these cations can be obtained in the phosphate coatings formed. This leads—in comparable cases of the Examples according to the invention versus the Comparison Examples—to distinctly improved protection against corrosion.

We claim:

1. A process for phosphating galvanized steel surfaces by immersion or spray/immersion treatment thereof with acidic aqueous solutions wherein:

a) the acidic aqueous solutions comprise:
$Zn^{2+}$ cations in quantities of 0.1 to 5 g/l,
$PO_4^{3-}$ anions in quantities of 5 to 50 g/l,
$NO_{3-}$ anions in quantities of 0.1 to 50 g/l,
$Mn^{2+}$ cations in quantities of 0.1 to 5 g/l and
$Cu^{2+}$ cations in quantities of 0.001 to 1 g/l, b) the acidic aqueous solutions have a
pH value of 1.5 to 4.5 and a temperature of 10° to 80° C. and are used for a treatment time of 1 to 300 seconds, and c) the galvanized steel surfaces are cathodically treated during phosphating with a direct current having a density of 0.01 to 100 mA/cm$^2$.

2. A process as claimed in claim 1, wherein the acidic aqueous solutions comprise:
$Zn^{2+}$ cations in quantities of 0.5 to 2 g/l,
$PO_4^{3-}$ anions in quantities of 10 to 20 g/l,
$NO_{3-}$ anions in quantities of 1 to 30 g/l,
$Mn^{2+}$ cations in quantities of 0.5 to 2 g/l and
$Cu^{2+}$ cations in quantities of 0.01 to 0.5 g/l.

3. A process as claimed in claim 2, wherein during the phosphating:
the pH value of the acidic aqueous solutions is from 2 to 3:
the temperature of the acidic aqueous solutions is from 40° to 70° C.; and the treatment time is from 2 to 30 seconds.

4. A process as claimed in claim 3, wherein, during phosphating, the galvanized steel surfaces are cathodically treated with a direct current having a density of 1 to 50 mA/cm$^2$.

5. A process as claimed in claim 4, wherein the acidic aqueous solutions used additionally contain $Mg^{2+}$ cations in quantities of 0.1 to 1 g/l.

6. A process as claimed in claim 5, wherein the acidic aqueous solutions used additionally contain simple or complex fluoride anions in quantities of 0.2 to 2 g/l.

7. A process as claimed in claim 6, in wherein the galvanized steel surfaces to be phosphated are subjected beforehand to an activating pretreatment with titanium-containing activating solutions.

8. A process as claimed in claim 7 also comprising subsequent painting or coating of the galvanized steel surfaces after treatment as recited in claim 7.

9. A process as claimed in claim 2, wherein, during phosphating, the galvanized steel surfaces are cathodically treated with a direct current having a density of 1 to 50 mA/cm$^2$.

10. A process as claimed in claim 9, wherein the acidic aqueous solutions used additionally contain $Mg^{2+}$ cations in quantities of 0.1 to 1 g/l.

11. A process as claimed in claim 10, wherein the acidic aqueous solutions used additionally contain simple or complex fluoride anions in quantities of 0.2 to 2 g/l.

12. A process as claimed in claim 1, wherein during the phosphating:

the pH value of the acidic aqueous solutions is from 2 to 3;

the temperature of the acidic aqueous solutions is from 40° to 70° C.; and the treatment time is from 2 to 30 seconds.

13. A process as claimed in claim 12, wherein, during phosphating, the galvanized steel surfaces are cathodically treated with a direct current having a density of 1 to 50 $mA/cm^2$.

14. A process as claimed in claim 13, wherein the acidic aqueous solutions used additionally contain $Mg^{2+}$ cations in quantities of 0.1 to 1 g/l.

15. A process as claimed in claim 14, wherein the acidic aqueous solutions used additionally contain simple or complex fluoride anions in quantities of 0.2 to 2 g/l.

16. A process as claimed in claim 1, wherein, during phosphating, the galvanized steel surfaces are cathodically treated with a direct current having a density of 1 to 50 $mA/cm^2$.

17. A process as claimed in claim 1, wherein the acidic aqueous solutions used additionally contain $Mg^{2+}$ cations in quantities of 0.01 to 2 g/l.

18. A process as claimed in claim 1, wherein the acidic aqueous solutions used additionally contain simple or complex fluoride anions in quantities of 0.1 to 50 g/l.

19. A process as claimed in claim 1, wherein the galvanized steel surfaces to be phosphated are subjected beforehand to an activating pretreatment.

20. A process as claimed in claim 1 also comprising subsequent painting or coating of the galvanized steel surfaces after treatment as recited in claim 1.

* * * * *